United States Patent [19]

Augustin

[11] 4,453,658

[45] Jun. 12, 1984

[54] EQUIPMENT FOR THE THREAD-ADJUSTED SEVERING OF A SEGMENT FROM A LENGTH OF FABRIC

[76] Inventor: Werner Augustin, Uerdinger Strasse 2-8, D-4150 Krefeld, Fed. Rep. of Germany

[21] Appl. No.: 409,175

[22] Filed: Aug. 18, 1982

[30] Foreign Application Priority Data

Sep. 17, 1981 [DE] Fed. Rep. of Germany ... 8127224[U]

[51] Int. Cl.[3] ..... B26F 3/02

[52] U.S. Cl. ..... 225/95; 225/105; 225/106

[58] Field of Search ..... 225/95, 105, 106, 101

[56] References Cited

U.S. PATENT DOCUMENTS

| | | | |
|---|---|---|---|
| 1,180,363 | 4/1916 | Allatt | 225/95 |
| 1,255,270 | 2/1918 | Allatt | 225/95 |
| 2,538,984 | 1/1951 | Sjostrom | 225/95 |
| 2,767,458 | 10/1956 | Meier | 83/487 X |
| 3,859,152 | 1/1975 | Brey et al. | 225/95 X |
| 3,945,278 | 3/1976 | Strauss et al. | 83/487 X |
| 4,156,378 | 5/1979 | Felten | 83/487 X |

*Primary Examiner*—Frank T. Yost

*Attorney, Agent, or Firm*—Shlesinger, Arkwright, Garvey & Fado

[57] ABSTRACT

Equipment for severing a segment from a length of fabric in a thread-adjusted manner has a bench with spaced first and second sides. A clamping system is mounted to the first side for releaseably clamping a first edge of the fabric. A carriage is displaceably mounted to the bench and is adapted for being displaced from the first to the second side. First and second adjacently disposed rotatable rollers are mounted to the carriage for engaging and ripping the fabric. A cylinder and piston system for displacing the carriage is mounted to the bench.

10 Claims, 3 Drawing Figures

EQUIPMENT FOR THE THREAD-ADJUSTED SEVERING OF A SEGMENT FROM A LENGTH OF FABRIC

The invention concerns equipment for the thread-adjusted severing of a segment from a length of fabric.

When cutting fabrics, in particular patterned fabrics, it is frequently important that the severing take place along specific lines predetermined by the pattern so that the subsequent sewing together of various cuts can take place according to the pattern. This will for instance always be the case when the fabric evinces a check pattern. While apparatus exists by means of which segments can be cut off a length of fabric, the cut guidance however will always depend on the guidance of the length of fabric or on the clamping of the length of fabric, and a pattern-adjusted cut in the sense above is hardly possible. Accordingly it is conventional practice to make a slight incision at the edge of the length of fabric, the fabric segment to be severed then being torn off the remaining length of fabric. This tearing off takes place in a manner adjusted for the thread, that is, the torn off edges are bounded by through-going threads.

It is the object of the invention to mechanize the thread-adjusted severing action.

This problem is solved by equipment of the initially described species, which is characterized by a spatially stationary holding system for one edge of the length of fabric to be severed and by a driven carriage with at least one support for the purpose of tearing open the length of material and to guide the mutually severed edges of on one hand the segment and on the other hand the remaining length of fabric.

As regards this equipment, one of the edges of the length of fabric is held in place and the support is moved transversely to the length of material, tearing open the length of material in a manner adjusted for the threads, and thereby severing a segment from the length of material.

In particular the holding system may comprise two clamps. The support can be a roll, however a preferred embodiment of the invention provides two rollers arranged one next to the other as the support. The carriages are preferably guided on one track extending substantially perpendicularly to the line connecting the two clamps.

A length of fabric to be severed is inserted by one of its edges into the clamps and fastened. Preferably the clamps are arranged on a bench, each time one clamping jaw being formed by a shackle extending across the bench surface and the other clamping jaw being formed by a movable, sliding head resting in the bench underneath the shackle. Accordingly the length of fabric can be spread on the bench and be smoothed. When the length of material is inserted into the clamps, the sliding head will be outside the surface that is covered by the fabric to be severed. Appropriately the sliding head will be mounted at the end of a piston rod of a pneumatically or hydraulically actuated operational cylinder which is operated when the length of fabric is inserted between the two clamping jaws. The edge of the length of fabric is held in place when the operational cylinder(s) undergo(es) actuation.

Thereupon a short incision is made in the edge of the length of fabric between the two clamps, whereby the nominal tearing location is determined in accordance with the pattern and moreover whereby the typically solid selvage is cut and the sliding head need only effect further tearing. The carriage preferably is arranged and guided underneath the bench surface, the rolls extending through a slot passing along the carriage path so as to be above the bench surface. The carriage may be driven by a pneumatically or hydraulically actuated operational cylinder which also guides the carriage and is mounted for that purpose underneath the slot. When the carriage drive is actuated, the two rolls are guided along the slot in extension of the incision in the length of fabric and tear it open in a manner adjusted for the threads.

To better guide the edges on one hand of the segment and on the other of the remaining length of fabric an embodiment is recommended wherein the rolls are designed as double conical rollers (DIABOLO rolls) of which the least cross-sections are flush with the bench surface. In this manner the length of fabric will be guided directly on the bench surface by the double conical rolls at least in the area of the tearing line.

An embodiment of the invention is discussed below as shown in the drawing.

Figure 1:
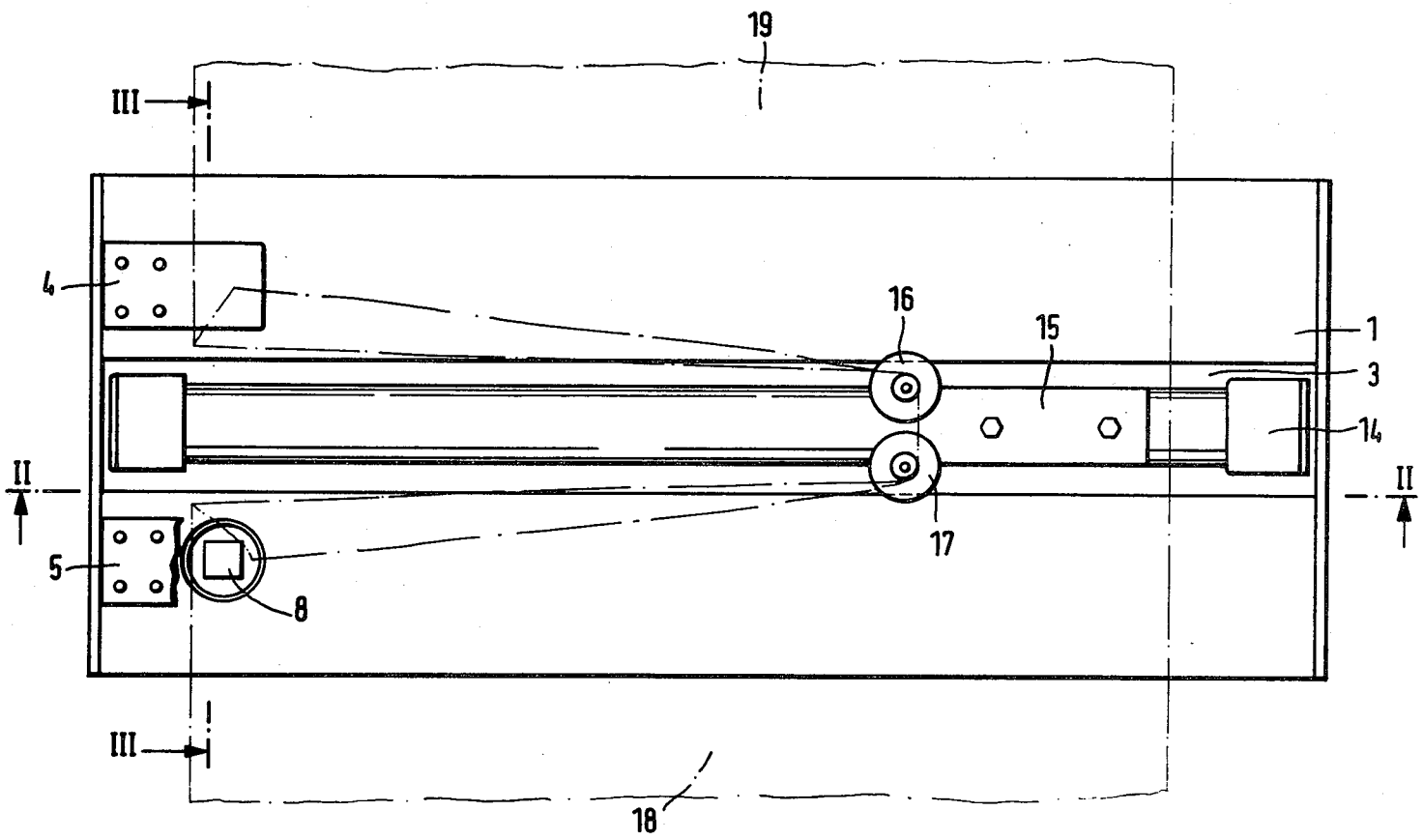
FIG. 1 is a top view of an equipment for severing in thread-adjusted manner a segment from a length of fabric.
Figure 2:
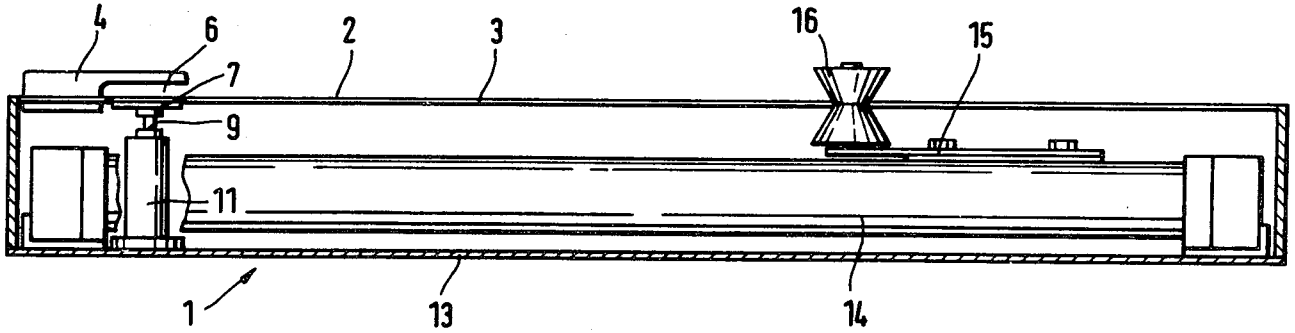
FIG. 2 is a section along the direction II—II through the object of FIG. 1.
Figure 3:
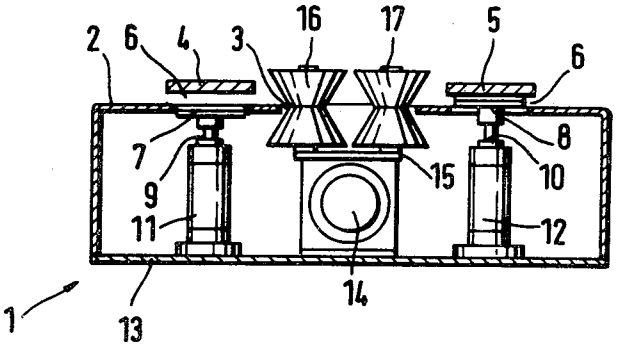
FIG. 3 is a section along the direction III—III through the object of FIG. 1.

The equipment shown basically consists of a box-like bench 1 of which the upper wall 2 comprises a slot 3 extending across the entire length of the bench. Shackles 4,5 are mounted at one end of the bench at its upper side and on both sides of the slot 3, the ends of these shackles that project in direction of the slot 3 each defining an insertion gap with the upper side of the bench 1. Apertures are located underneath the projecting ends of the shackles 4,5 in the upper wall 2 of the bench 1, which hold sliding heads 7,8. The sliding heads are located at the ends of piston rods 9,10 of pneumatically actuated opertional cylinders 11,12 fixed to the bottom 13 of the box-shaped bench. Accordingly the sliding heads 7,8 can be moved toward the projecting ends of the shackles 4,5 when the operational cylinders 11,12 are actuated. The projecting ends of the shackles 4,5 and the sliding heads 7,8 form therefore the clamping jaws of clamps.

Another operational cylinder 14 is mounted underneath the slot 3 to the bottom 13 of the bench 1 and extends over the entire length of the bench 1, acting as the guide means and the drive for a carriage 15 displaceable along the slot 3. The carriage 15 comprises two rolls 16,17 at its upper side which are designed as double conical rollers (DIABOLO rollers). The rolls 16,17 are arranged in such a manner that the line connecting their axes runs perpendicularly to the direction of the slot 3 and so that their least cross-sections are approximately at the level of the bench surface. Moreover, the rolls 16,17 are supported in freely rotatable manner on the carriage 15.

The operational cylinders 11,12 and 14 can be controlled in suitable manner. A control means is omitted from the drawing.

The procedure to sever a segment 18 from a length of fabric 19 is as follows:

The edge of the length of fabric 19 is inserted in the insertion gaps 6 between the projecting ends of the shackles 4,5 and sliding heads 7,8. Thereupon the operational cylinders 11,12 are actuated, whereby the edge of the length of fabric 19 is clamped tight. The carriage 15 with the rolls 16, 17 is in the area of the clamps. Prior or after clamping, a small incision is made in the edge of the length of fabric 19, so that the rims of the incision can rest against or around the rolls 16,17. After the operational cylinder 14 has been actuated, the carriage 15 with the rolls 16,17 is displaced away from the clamps along the slot 3. In the process, the length of fabric is torn open so the threads be straight. The tear edges are guided at the least cross-sections of rolls 16,17 directly at the bench surface. After the segment 18 has been torn off in this manner from the length of fabric 19, the clamps are released by actuating the operational cylinders 11,12 and the carriage 15 is returned to its initial position.

I claim:

1. Equipment for severing a segment from a length of fabric in a thread-adjusted manner, comprising:

(a) a bench having first and second spaced sides;

(b) first and second clamp means mounted to said first side and adapted for releasably clamping a first edge of said fabric;

(c) carriage means displaceably mounted to said bench between said first and second clamp means and adapted for being displaced from said first side to said second side;

(d) first and second adjacently disposed rotatable roller means mounted to said carriage means and displaceable therewith, said roller means adapted for engaging said fabric; and, (e) means for displacing said carriage means from said first to said second side whereby said fabric when grasped by said clamp means is torn between said roller means as said carriage is displaced from said first to said second side.

2. The equipment as defined in claim 1, wherein:

(a) said clamp means includes at least two clamps.

3. The equipment as defined in claim 2, wherein:

(a) said bench includes an upper wall portion and a bottom generally parallel thereto;

(b) each of said at least two clamps includes a shackle having a portion thereof spaced from and extending generally parallel to said upper wall for defining a clamping slot;

(c) at least two apertures in said upper wall, each of said apertures aligned with an associated shackle; and, (d) at least two sliding heads displaceably disposed beneath said upper wall, each of said sliding heads associated with one of said shackles and aligned with an associated aperture for cooperating with said associated shackle for clamping said fabric therebetween.

4. The equipment as defined in claim 3, wherein:

(a) cylinder and piston means are mounted to said bottom wall; and, (b) said sliding heads are mounted to said cylinder and piston means for being displaced thereby.

5. The equipment as defined in claim 4, wherein:

(a) a pair of cylinder and piston means;

(b) each of said sliding heads are mounted to one of said cylinder and piston means.

6. The equipment as defined in claim 3, wherein:

(a) guide means are associated with said bench for guiding said carriage means generally transverse of said first side.

7. The equipment as defined in claim 6, wherein:

(a) said guide means are disposed beneath said upper wall;

(b) said upper wall includes a slot therethrough extending generally transversely of said first and second sides and therebetween; and, (c) said roller means having a portion thereof extending upwardly beyond said slot.

8. The equipment as defined in claim 7, wherein:

(a) said roller means includes double conical rollers having a section therethrough of least cross-section; and, (b) said section disposed generally adjacent said upper wall.

9. The equipment as defined in claim 7, wherein:

(a) said means for displacing said carriage means includes cylinder and piston means.

10. The equipment as defined in claim 9, wherein:

(a) said guide means are integral with said means for displacing said carriage means.

* * * * *